United States Patent [19]

Tijunelis et al.

[11] 4,284,841

[45] Aug. 18, 1981

[54] CABLE

[75] Inventors: Donatas Tijunelis, Buffalo Grove, Ill.; Clinton A. Boyd, Tulsa; Joseph E. Vandevier, Broken Arrow, both of Okla.

[73] Assignee: Centrilift, Inc., Tulsa, Okla.

[21] Appl. No.: 73,414

[22] Filed: Sep. 7, 1979

[51] Int. Cl.[3] ..... H01B 7/22

[52] U.S. Cl. ..... 174/103; 174/102 R; 174/105 SC; 174/11 ON; 174/107; 174/117 F

[58] Field of Search ..... 174/103, 106 SC, 110 N, 174/117 F, 102 R, 102 SC, 105 SC, 107

[56] References Cited

U.S. PATENT DOCUMENTS

| | | | |
|---|---|---|---|
| Re. 21,926 | 10/1941 | Bormann | 174/106 SC |
| 2,203,232 | 6/1940 | Osborne | 174/107 X |
| 2,377,153 | 5/1945 | Hunter | 174/106 SC X |
| 3,710,009 | 1/1973 | Hoeg | 174/120 AR |
| 3,742,363 | 6/1973 | Carle | 174/102 R |
| 3,809,802 | 5/1974 | Pearson | 174/103 |
| 3,882,060 | 5/1975 | Guzy | 260/37 AL |
| 3,889,049 | 6/1975 | Legg | 174/102 R |
| 3,926,900 | 12/1975 | Guzy | 260/33 AQ |
| 4,096,351 | 6/1978 | Wargin | 174/102 R |

*Primary Examiner*—Richard R. Kucia
*Attorney, Agent, or Firm*—Robert A. Felsman

[57] ABSTRACT

Electrical conductors having suitable combinations of coatings and coverings are disclosed which have the ability to inhibit low molecular weight hydrocarbon well fluids when under pressure and withstand high proportions of gassy hydrocarbons under pressure without undergoing rupture failure.

9 Claims, 2 Drawing Figures

CABLE

BACKGROUND OF THE INVENTION

There are many insulated electrical cables for use in high temperature oil well, some of which are suitable for high pressure gassy oil wells. An example of such a cable is described and claimed in U.S. Pat. No. 4,096,351 granted to Robert V. Wargin and Clinton A Boyd on June 20, 1978.

Problems have arisen where the well fluid is very corrosive, as found, for example, in Mexico. In order to protect electrical cables in such wells, a jacket or sheath of lead is used over the insulated conductor. The life of these cables is relatively short because the jacket, not being exceptionally strong, becomes damaged and/or embrittled, especially when the cable is pulled during changes or replacement of the pumps.

THE INVENTION

According to this invention, an electrical cable, especially suitable for use in high temperature, gassy (high methane and hydrogen sulfide atmospheres) and corrosive well fluids comprise a copper conductor which may be coated with lead, lead-tin alloy, tin, or aluminum (if stranded, each strand may be coated accordingly and the voids between these strands filled with a conductive resilient material), a high electric resistivity plastic cover surrounding the conductor (and its coating, if any), a continuous lead, lead-tin alloy or aluminum sheath covering the high electric resistivity plastic, an oil resistant insulation protecting the lead sheath, a braid tightly wrapping the oil resistant insulation and an external armor, and optionally, a layer of polyvinyl fluoride tape between the oil resistant insulation and the braid layer. Each layer of the cable has a specific purpose which will be discussed later herein.

In a specific construction, the high electric resistivity plastic cover surround the conductor (and its coating, if any,) comprises a high temperature polyimide film, such as "KAPTON", manufactured by E.I. du Pont de Nemours and Company, which has a dielectric strength in excess of 5000 volts/mil, an operating temperature an excess of 500° F. and which is impervious to attack by acids, hydrocarbons and other materials. The "KAPTON" film may, in one embodiment, be continuously sheathed in lead, a lead-tin alloy or aluminum. The highly resistive and rigid "KAPTON" film provides a support for the lead or other sheath, and protects the sheath against indentations and other physical damage which occur where the sheath covers merely a soft layer of cable insulation, as in prior art structure.

The covering over the sheathed conductor of the oil resistant insulating material is relatively soft and provides additional protection to the relatively soft sheath against external damage. A suitable oil resistant insulating material comprises an EPDM material, such as disclosed in U.S Pat. Nos. 3,026,900 granted to Raymond L. Gluzy and Rajesh N. Sheth on Dec. 15, 1975 and U.S. Pat. No. 3,882,060 granted to Raymond L. Guzy on May 6, 1975.

A layer of a polyvinyl fluoride tape may surround the oil resistant insulating material; a suitable material is "TEDLAR" manufactured by E. I. du Pont de Nemours and Company. Over this film, a braid surrounds the conductor, such being selected from the group comprising nylon fiber, polyethylene terephthalatic fiber, glass fiber, a polyamid fiber and a fluropolymer fiber.

Braids of this group are described in U.S. Pat. No. 4,096,351 granted to Robert V. Wargin and Clinton A. Boyd on June 20, 1978. The braided conductor is armored by a metal or plastic armor as is known in the prior art. One such plastic armor is an extruded polyolefin as disclosed in U.S. Pat. No. 3,710,009 granted to Donald Hoeg, Leo Legg and Donatis Tijunelis on Jan. 1, 1973.

THE DRAWING

FIG. 1 is a sectional view through one form of a cable constructed according to this invention; and FIG. 2 is a sectional view of a second embodiment of a cable according to this invention.

DETAILED DESCRIPTION

Figure 1:
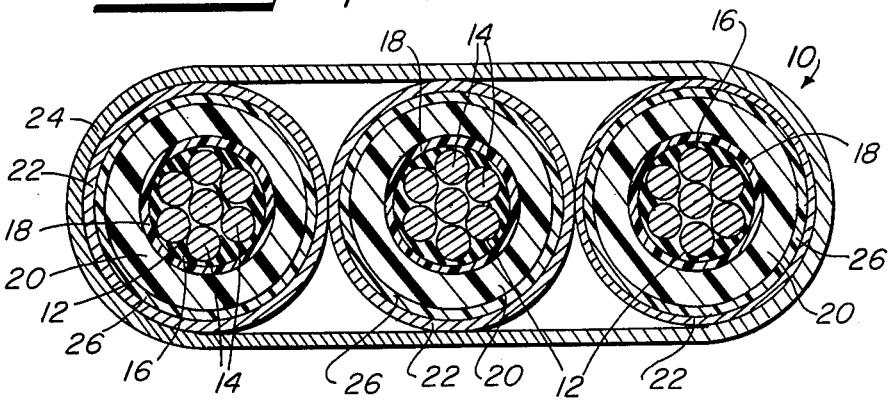

Attention is invited to FIG. 1 of the drawing which illustrates in section one form of a cable constructed according to this invention. The cable 10 comprises three conductors 12, each having a plurality of strands 14 which are twisted together. Preferably the strands are made of copper. The conductors 12 are each covered with a conductive rubber 16 in such a manner that no voids exist between the strands 14. Each covered conductor is covered with a relatively thin continuous layer of a high temperature, high electric resistivity plastic 18, such as "KAPTON", a polyimide manufactured by E. I. du Pont de Nemours and Company. Surrounding the "KAPTON" is a thicker layer of an oil-resistant EPDM insulation 20, an elastomeric material such as described in U.S. Pat. Nos. 3,882,060 and 3,026,900 granted to R. L. Guzy and R. L. Guzy and R. N. Sheth, respectively. This elastomeric layer is covered with a braid 22, selected from the group comprising nylon fiber, polyethylene terephthetate fiber, glass fiber, polyamid fiber and fluropolymer fiber. A metal or plastic armor 24 surrounds the cable 10.

An optional wrap of a tape 26, such as "TEDLAR" a polyvinyl flouride also manufactured by E. I. du Pont de Nemours and Company surrounds the EPDM insulation 20, which wrap enhances the physical properties of the insulation in a gassy, hydrocarbon environment by containing the physical swell of the insulation material while allowing gas to permeate through the wrap via the overlap seams.

Figure 2:
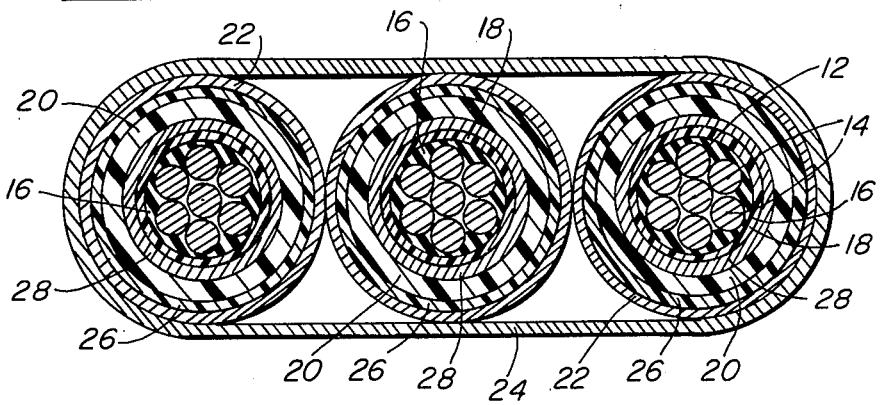

FIG. 2 illustrates a second embodiment in which, in addition to the various elements of the FIG. 1 embodiment, a lead sheath 28 is extruded around the plastic 18 to further protect the copper conductor.

Both embodiments are illustrated as flat configurations. The flat construction contains physical swelling caused by gas permeating into the cable. Also because the profile is much lower than a round cable, the possibility of mechanical danger is minimized when pulling and installing the cable. However, the cable can be of a different configuration without departing from the spirit of the invention.

Additionally, a continuous coating of lead, lead-tin alloy or aluminum may be deposited otherwise adhered to the copper strands which can provide additional protection for the copper from attack in situations where there are highly corrosive gases, such as high concentrations of methane, hydrogen sulfide and possibly ammonium sulfate. The additional coating can also protect each strand conductor against reactions with the elastomeric coating.

The conductive rubber around the strands of coated copper not only acts to conduct current but also protects the coating on the copper conductors from mechanical damage which can occur because of the softness of the coating.

Around the conductive rubber is a layer of a polyimide film, such as "KAPTON", previously mentioned. This layer enhances the cable construction dielectrically, physically and thermally because this material has a typical dielectric strength greater than 5000 volts/mil; is impervious to attack by acids, hydrocarbons, and the like; and the film is capable of operating at temperatures in excess of 500° F. The material is rigid and nondeforming and because of its dielectric strength need only be a relatively thin layer. A lead, lead-tin alloy or aluminum sheath or an extruded coating can surround the "KAPTON" layer. This soft sheath is protected from indentations and the like by the rigid "KAPTON".

To further protect the insulated conductors, they are sheathed in an extruded jacked of insulating material which also resists penetration by well fluids. The jacket comprises, for example, a suitable elastomer, such as the EPDM elastomers disclosed in U.S. Pat. Nos. 3,882,060 and 3,926,900, supra.

The sheathed conductors are each surrounded and confined by a layer of braid. Materials commonly employed in the cable art for this purpose include a variety of nylon filament braids and a material particularly useful for this purpose is a nylon 66, braided and lacquered with a nylon lacquer. Other materials, as previously mentioned can be used for the braid.

Conductors as described are not susceptible to depressurization failures when surrounded by well fluids under high temperature and pressures. The braid layer tightly surrounds the insulation where minor amounts of low molecular weight well fluid permeate the somewhat porous insulation layer and perhaps invade the conductor area, the braid layer restrains the insulation layer against swell and rupture from high internal pressure, and the low molecular weight fluids are desorbed without rupture or damage to the insulation.

The braided conductors are enclosed within an outer armor which provides mechanical protection against abrasion and damage in use. The outer armor can be metal or an elastomer; it can be a wrapped construction which permits ingress and egress of well fluids; the absence of an impermeable jacketing permits the fluids to freely escape during a rapid depressurizing.

The extruded elastomeric covering may also be wrapped with a tape of "TEDLAR" a polyvinyl fluoride film, before referred to, over which the braid is placed. The wrapped tape enhances the physical property of the insulation in gassy, hydrocarbon environments by containing the physical swell of the insulation material yet allows gas to permeate through via the overlap seams. This tape also enhances the cable dielectrically and mechanically.

We claim:

1. In a multiple conductor cable especially suitable for high temperature use, the combination of each conductor comprising:

a plurality of strands comprising copper;

a resilient material surrounding each conductor and filling any voids between the strands thereof;

a high electric resistivity plastic covering said resilient material;

a lead jacket surrounding said high electric resistivity plastic;

an oil resistant insulation material surrounding said lead jacket;

a braid layer tightly covering said insulation material; and an external armor surrounding said braid layer.

2. In a multiple conductor cable as recited in claim 1 where said conductor is covered by an inert metal selected from the group comprising lead, a lead-tin alloy and aluminum.

3. In a multiple conductor cable as recited in claim 1 where said resilient material comprises an electrically conductive rubber.

4. In a multiple conductor cable as recited in claim 1 where said high electric resistivity plastic comprises a relatively rigid, high temperature resistant polyimide.

5. In a multiple conductor cable as recited in claim 1 where said oil resistant insulating material comprises an EPDM elastomer.

6. In a multiple conductor cable as recited in claim 1 where said braid is selected from the group comprising nylon fiber, polyethylene fiber, glass fiber, polyamide fiber and fluropolymer fiber.

7. In a multiple conductor cable as recited in claim 1 where said armor is selected from the group comprising metal and plastic.

8. In a cable as recited in claim 1 further comprising a polyvinyl fluoride tape wound around said oil resistant insulating material.

9. In a cable as recited in claim 1 further comprising a coating of an alloy containing lead on each of said copper strands.

* * * * *